US007162188B2

(12) United States Patent
Sudo et al.

(10) Patent No.: US 7,162,188 B2
(45) Date of Patent: Jan. 9, 2007

(54) TONER CONTAINER AND IMAGE FORMING APPARATUS USING THE SAME

(75) Inventors: Kazuhisa Sudo, Kanagawa (JP); Yoshio Hattori, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 363 days.

(21) Appl. No.: 10/757,444

(22) Filed: Jan. 15, 2004

(65) Prior Publication Data

US 2004/0146320 A1 Jul. 29, 2004

Related U.S. Application Data

(63) Continuation of application No. 10/678,091, filed on Oct. 6, 2003, now Pat. No. 6,813,460, which is a continuation of application No. 10/059,187, filed on Jan. 31, 2002, now Pat. No. 6,665,508.

(30) Foreign Application Priority Data

Jan. 31, 2001 (JP) ..... 2001-023597
Feb. 13, 2001 (JP) ..... 2001-035481
Dec. 28, 2001 (JP) ..... 2001-400638

(51) Int. Cl.
*G03G 15/08* (2006.01)

(52) U.S. Cl. ..... 399/258; 399/262

(58) Field of Classification Search ..... 399/107, 399/119, 120, 252, 258, 262; 222/DIG. 1
See application file for complete search history.

(56) References Cited

U.S. PATENT DOCUMENTS 4,274,455 A 6/1981 Simons
4,377,334 A 3/1983 Nishikawa
4,499,849 A 2/1985 Tomita et al.
4,503,625 A 3/1985 Manzer
4,547,059 A 10/1985 Nagayama et al.
4,571,070 A 2/1986 Tomita et al.
4,607,939 A 8/1986 Saito
4,615,364 A 10/1986 Kawata
4,740,808 A 4/1988 Kasamura et al.
4,945,956 A 8/1990 Bueyuekgueclue et al.
4,984,023 A 1/1991 Yoshida
5,014,094 A 5/1991 Amitani et al.
5,034,776 A 7/1991 Suigiura
5,074,342 A 12/1991 Kraehn
5,074,344 A 12/1991 Vacek et al.

(Continued)

FOREIGN PATENT DOCUMENTS

EP 0 666 516 A1 8/1995

(Continued)

OTHER PUBLICATIONS

U.S. Appl. No. 10/956,101, filed Oct. 4, 2004, Sudo et al.

(Continued)

*Primary Examiner*—Hoan Tran
(74) *Attorney, Agent, or Firm*—Oblon, Spivak, McClelland, Maier & Neustadt, P.C.

(57) ABSTRACT

A toner container of the present invention stores powdery toner to be replenished via a toner outlet thereof and includes a container body. A shutter device is positioned in the toner outlet for selectively opening or closing the toner outlet. The shutter device includes an opening/closing member, a resilient member constantly biasing the opening/closing member from the inside toward the outside of the container body, and a support member supporting the resilient member and opening/closing member. The toner container is simple and easy to mount and dismount from an image forming apparatus while surely preventing the toner from leaking.

47 Claims, 14 Drawing Sheets

U.S. PATENT DOCUMENTS 5,089,854 A * 2/1992 Kaieda et al. ..... 399/262
5,105,222 A 4/1992 Ohta et al.
5,150,162 A 9/1992 Saito
5,386,274 A 1/1995 Sanpe et al.
5,412,364 A 5/1995 Iguchi et al.
5,570,170 A 10/1996 Muranyl et al.
5,576,816 A 11/1996 Staudt et al.
5,592,267 A 1/1997 Misago et al.
5,592,980 A 1/1997 Stern et al.
5,595,223 A 1/1997 Hayao
5,638,159 A 6/1997 Kai et al.
5,638,989 A 6/1997 Ophardt et al.
5,652,944 A 7/1997 Masuda et al.
5,655,180 A 8/1997 Yasuda et al.
5,655,195 A 8/1997 Ichikawa et al.
5,663,788 A 9/1997 Sanpe
5,710,963 A 1/1998 Dirx
5,734,957 A 3/1998 Ogawa et al.
5,737,680 A 4/1998 Takagaki et al.
5,740,507 A 4/1998 Ichikawa et al.
5,797,074 A 8/1998 Kasahara et al.
5,815,784 A 9/1998 Kasahara et al.
5,848,326 A 12/1998 Komuro et al.
5,875,380 A 2/1999 Iwata et al.
5,878,317 A 3/1999 Masuda et al.
5,915,154 A 6/1999 Schoch et al.
5,950,055 A 9/1999 Yahata et al.
5,953,567 A 9/1999 Muramatsu et al.
5,960,238 A 9/1999 Ohgami
5,960,246 A 9/1999 Kasahara et al.
5,962,783 A 10/1999 Iwata et al.
5,970,290 A 10/1999 Yoshiki et al.
5,970,292 A 10/1999 Miller
5,987,298 A 11/1999 Muramatsu et al.
6,014,536 A 1/2000 Ban et al.
6,032,010 A 2/2000 Kim et al.
6,112,046 A 8/2000 Suzuki et al.
6,115,571 A * 9/2000 Kobayashi ..... 399/119
6,122,468 A 9/2000 Sakamoto et al.
6,128,459 A 10/2000 Iwata et al.
6,142,690 A 11/2000 Yoshimura et al.
6,163,669 A 12/2000 Aoki et al.
6,193,113 B1 2/2001 Hidding
6,198,895 B1 3/2001 Tsuda et al.
6,201,941 B1 3/2001 Kasahara et al.
6,249,304 B1 6/2001 Sawayama et al.
6,249,305 B1 6/2001 Miyamoto et al.
6,269,234 B1 7/2001 Kurz et al.
6,282,396 B1 8/2001 Iwata et al.
6,292,644 B1 9/2001 Goto et al.
6,295,437 B1 9/2001 Hodoshima et al.
6,304,739 B1 10/2001 Katsuyama et al.
6,332,065 B1 12/2001 Howard
6,337,957 B1 1/2002 Tamaki et al.
6,363,232 B1 3/2002 Flaherty
6,370,349 B1 * 4/2002 Tsuji et al. ..... 399/262
6,381,435 B1 4/2002 Shinohara et al.
6,386,392 B1 5/2002 Argentieri et al.
6,393,241 B1 5/2002 Matsumoto et al.
6,465,144 B1 10/2002 Hashimoto et al.
6,501,913 B1 12/2002 Hattori et al.
6,505,014 B1 1/2003 Aoki et al.
6,505,022 B1 1/2003 Kosuge et al.
6,507,720 B1 1/2003 Kabumoto et al.
6,522,855 B1 2/2003 Katoh et al.
6,526,246 B1 2/2003 Iwata et al.
6,542,707 B1 4/2003 Muramatsu et al.
6,567,637 B1 5/2003 Yanagisawa et al.
6,571,076 B1 5/2003 Kasahara et al.
6,576,388 B1 6/2003 Sakon et al.
6,591,077 B1 7/2003 Yanagisawa et al.
6,597,883 B1 7/2003 Muramatsu et al.
6,597,884 B1 7/2003 Miyaguchi et al.
6,608,983 B1 8/2003 Terazawa et al.
6,608,984 B1 8/2003 Matsumoto et al.
6,628,908 B1 9/2003 Matsumoto et al.
6,628,913 B1 9/2003 Matsumoto et al.
6,628,915 B1 9/2003 Muramatsu et al.
6,640,073 B1 10/2003 Kurotori et al.
6,653,037 B1 11/2003 Sawada et al.
6,665,508 B1 12/2003 Sudo et al.
6,669,189 B1 12/2003 Seto et al.
6,671,484 B1 12/2003 Miyoshi et al.
6,678,492 B1 1/2004 Terazawa et al.
6,681,096 B1 1/2004 Seto et al.
6,686,946 B1 2/2004 Masuda et al.
6,701,114 B1 3/2004 Sekine et al.
6,716,561 B1 4/2004 Shiraishi et al.
6,721,516 B1 4/2004 Shiraishi et al.
6,748,190 B1 6/2004 Yanagisawa et al.
6,757,511 B1 6/2004 Sugimoto et al.
6,768,879 B1 7/2004 Kosuge
6,775,503 B1 8/2004 Hattori et al.
6,775,511 B1 8/2004 Kosuge
6,785,496 B1 8/2004 Iwata et al.
6,792,234 B1 9/2004 Ikeguchi et al.
6,793,331 B1 9/2004 Anderson et al.
6,799,012 B1 9/2004 Shakuoto et al.
6,813,460 B1 11/2004 Sudo et al.
6,819,892 B1 11/2004 Nakazato et al.
6,829,460 B1 12/2004 Kurotori et al.
6,852,459 B1 2/2005 Katoh et al.
6,858,365 B1 2/2005 Sawada et al.
2004/0146320 A1 1/2004 Sudo et al.
2004/0091289 A1 5/2004 Terazawa et al.
2004/0146319 A1 7/2004 Sudo et al.
2004/0197119 A1 10/2004 Matsumoto et al.

FOREIGN PATENT DOCUMENTS

EP 0 681 226 A2 11/1995
EP 0 895 137 A1 2/1999
EP 1 006 415 6/2000
EP 1 030 227 8/2000
EP 1 126 328 8/2000
EP 1 154 333 11/2001
EP 1 184 738 A1 3/2002
EP 1193570 11/2004
EP 1014214 6/2005
JP 57-057451 4/1982
JP 58-123444 8/1983
JP 58-182947 12/1983
JP 59-9360 1/1984
JP 59-15057 1/1984
JP 59-027558 2/1984
JP 59-38459 3/1984
JP 60-3856 1/1985
JP 60-82651 6/1985
JP 60-232578 11/1985
JP 1-24739 1/1986
JP 61-059464 3/1986
JP 61-156176 7/1986
JP 63-271378 11/1988
JP 64-17550 1/1989
JP 64-052181 2/1989
JP 02-053055 2/1990
JP 03-208066 9/1991
JP 3-68816 10/1991
JP 03-241372 10/1991
JP 3-267965 11/1991
JP 4-009082 1/1992
JP 04-087901 3/1992
JP 04-134471 5/1992
JP 04-143781 5/1992

| | | |
|---|---|---|
| JP | 5-19624 | 1/1993 |
| JP | 5-46022 | 2/1993 |
| JP | 05-232810 | 9/1993 |
| JP | 05-323838 | 12/1993 |
| JP | 06-059572 | 3/1994 |
| JP | 6-175490 | 6/1994 |
| JP | 06-191049 | 7/1994 |
| JP | 06-208301 | 7/1994 |
| JP | 6-214459 | 8/1994 |
| JP | 6-222669 | 8/1994 |
| JP | 07-020702 | 1/1995 |
| JP | 7-44005 | 2/1995 |
| JP | 07-261529 | 10/1995 |
| JP | 7-261531 | 10/1995 |
| JP | 08-137229 | 5/1996 |
| JP | 08-171281 | 7/1996 |
| JP | 08-171331 | 7/1996 |
| JP | 08-211723 | 8/1996 |
| JP | 08-292636 | 11/1996 |
| JP | 8-297397 | 11/1996 |
| JP | 08-314272 | 11/1996 |
| JP | 09-006108 A | 1/1997 |
| JP | 09-022175 | 1/1997 |
| JP | 09-106156 | 4/1997 |
| JP | 09-166912 | 6/1997 |
| JP | 09-197818 | 7/1997 |
| JP | 9-197819 | 7/1997 |
| JP | 09-292773 | 11/1997 |
| JP | 09-305080 | 11/1997 |
| JP | 10-63078 | 3/1998 |
| JP | 10-063087 | 3/1998 |
| JP | 10-097130 | 4/1998 |
| JP | 10-123814 | 5/1998 |
| JP | 10-198151 | 7/1998 |
| JP | 10-218193 | 8/1998 |
| JP | 10-293452 | 11/1998 |
| JP | 10-319694 | 12/1998 |
| JP | 11-65253 | 3/1999 |
| JP | 11-237823 | 8/1999 |
| JP | 11-272075 | 10/1999 |
| JP | 11-282236 | 10/1999 |
| JP | 11-295972 | 10/1999 |
| JP | 2000-128192 | 5/2000 |
| JP | 2000-147879 | 5/2000 |
| JP | 2000-194182 | 7/2000 |
| JP | 2000-227706 | 8/2000 |
| JP | 2000-267413 | 9/2000 |
| JP | 2000-267415 | 9/2000 |
| JP | 2000-356898 | 12/2000 |
| JP | 2001-175083 | 6/2001 |
| JP | 3-269461 | 12/2001 |
| JP | 2002-23472 | 1/2002 |
| JP | 3391718 | 1/2003 |
| JP | 2004-046268 | 2/2004 |
| JP | 3572500 | 7/2004 |

OTHER PUBLICATIONS

U.S. Appl. No. 10/757,444, filed Jan. 15, 2004, Sudo et al.
Jun-ichi Matsumoto et al. Toner Replenishment System Using Flexible Toner Cartridge, Imaging Technology Division, Ricoh Company, Ltd., Jun. 12, 2003.
U.S. Appl. No. 09/826,789, filed Apr. 5, 2001, pending.
U.S. Appl. No. 10/107,249, filed Mar. 28, 2002, pending.
U.S. Appl. No. 10/227,303, filed Aug. 26, 2002, pending.
U.S. Appl. No. 10/227,308, filed Aug. 26, 2002, pending.
U.S. Appl. No. 11/208,739, filed Aug. 23, 2005, Sudo et al.

* cited by examiner

TONER CONTAINER AND IMAGE FORMING APPARATUS USING THE SAME

CROSS-REFERENCE TO RELATED APPLICATIONS

The present application is a continuation of application Ser. No. 10/678,091, filed on Oct. 6, 2003 now U.S. Pat. No. 6,813,460, which is a continuation of application Ser. No. 10/059,187 (now U.S. Pat. No. 6,665,508), filed on Jan. 31, 2002, the entire contents of each of which is incorporated herein by reference.

BACKGROUND OF THE INVENTION

1. Field of the Invention

The present invention relates to a copier, printer, facsimile apparatus or similar electrophotographic image forming apparatus and more particularly to a toner container to be removably mounted to an image forming apparatus for replenishing toner to a developing device.

2. Description of the Background Art

While a toner container mounted to an image forming apparatus is usually replaced by the user, the replacement often causes toner to scatter and is awkward to perform. A toner container easy to mount and dismount without causing toner to scatter has been proposed in various forms in the past. For example, a toner container whose cap is automatically opened when the container is moved and is therefore easy to use is available. However, this kind of toner container has sophisticated, expensive structure.

There has been proposed an image forming apparatus and a toner container constructed to solve the above problem. The toner container has its toner outlet automatically opened when simply inserted into the setting portion of the apparatus from the above or has it automatically closed when simply pulled out of the setting portion. A nozzle extends upward from the setting portion. The toner container includes a self-closing valve that opens when the nozzle is inserted into the toner container. The self-closing valve is implemented as a sponge seal formed of compressed foam sponge non-permeable to air and formed with a cruciform slit. The sponge seal elastically deforms when the nozzle is inserted into the slit of the seal or closes the slit when the nozzle is removed from the slit, thereby preventing toner from leaking.

However, the problem with the sponge seal is that the elastic restoring force is apt to decrease due to, e.g., creep when the seal hardens in a low-temperature environment or due to aging. The sponge seal reduced in restoring force often causes the toner to leak when the toner is pulled out of the setting portion. Particularly, the toner outlet is positioned at the bottom of the toner container. Therefore, when the closing movement of the sponge seal is delayed at the time of mounting or dismounting of the toner container, the toner scatters around the setting portion due to its own weight. Moreover, the nozzle is apt to tear off or shave off the sponge seal at the time of mounting and dismounting. The resulting pieces of the sponge seal would degrade image quality if introduced in the developing device.

It has been proposed to dispose a mechanical shutter, which closes under the action of a spring, in the toner container. The mechanical shutter, however, reduces the substantial area of the portion of the toner container that leads to the toner outlet, causing the toner to bridge. Particularly, it is likely that a flexible toner bag forming part of the toner container is folded or inclined, aggravating the bridging of the toner.

Technologies relating to the present invention are disclosed in, e.g., Japanese Patent Laid-Open Publication No. 7-20702, 9-197818 and 2000-267415.

SUMMARY OF THE INVENTION

It is an object of the present invention to provide a toner container or similar powder container extremely simple in structure and easy to handle while surely preventing toner from leaking, and an image forming apparatus using the same.

It is another object of the present invention to provide a toner container or similar powder container causing a minimum of toner to remain therein due to bridging despite the use of a mechanical shutter, and an image forming apparatus using the same.

A toner container of the present invention stores powdery toner to be replenished via a toner outlet thereof and includes a container body. A shutter device is positioned in the toner outlet for selectively opening or closing the toner outlet. The shutter device includes an opening/closing member, a resilient member constantly biasing the opening/closing member from the inside toward the outside of the container body, and a support member supporting the resilient member and opening/closing member.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
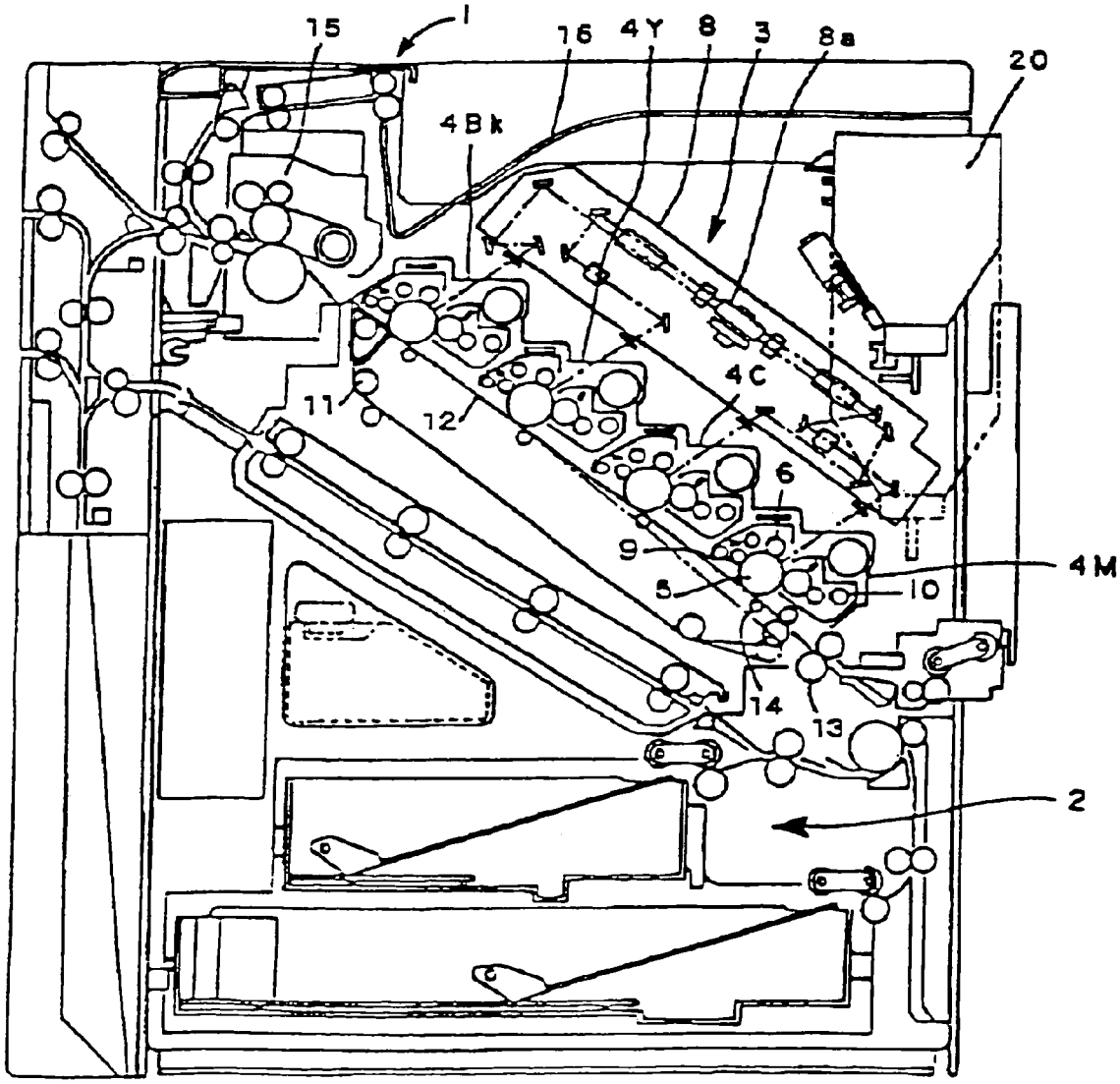
FIG. 1 is a view showing an image forming apparatus using a toner container embodying the present invention.

Referring to FIG. 1 of the drawings, an image forming apparatus embodying the present invention is shown and implemented as a color laser printer by way of example. As shown, the printer includes a printer body 1. A sheet feeding section and an image forming section 3 are respectively arranged in the upper portion and lower portion of the printer body 1. The image forming section 3 includes an image transfer belt device generally inclined downward toward the sheet feeding section 2. The image transfer belt device includes a plurality of (four in the illustrative embodiment) rollers 11 and an endless, image transfer belt 12 passed over the rollers 11. A drive source, not shown, is drivably connected to one of the rollers 11 for driving the belt 12 counterclockwise, as indicated by an arrow in FIG. 1.

A magenta (M), a cyan (c), a yellow (Y) and a black (Bk) image forming unit 4M, 4C, 4Y and 4Bk, respectively, are sequentially arranged in this order, as named from the bottom to the top. The image forming units 3M through 4Bk are arranged side by side above the upper run of the image transfer belt (simply belt hereinafter) 12. The image forming units 4M through 4Bk each include a photoconductive drum or image carrier 5 rotatable clockwise, as viewed in FIG. 1, by being driven by drive means not shown. Arranged around the drum 1 are a charge roller or charging means 6, an optical writing unit 8, a developing device or developing means 10, and a cleaning device or cleaning means 9. The developing device 10 stores a toner and carrier mixture or two-ingredient type developer. A toner replenishing device, which will be described later, replenishes fresh toner to the developing device 10, as needed.

The operation of the color printer in a full-color mode will be described hereinafter. First, in the magenta image forming unit 4M, for example, the charge roller 6 uniformly charges the surface of the drum 5. In the optical writing unit 8, a laser diode, not shown, is driven in accordance with M image data to emit a laser beam toward a polygonal mirror 8*a*. The laser beam steered by the polygonal mirror 8*a* is incident to the charged surface of the drum 5 via, e.g., a cylindrical lens and scans the surface of the drum 5, thereby writing a latent image. The developing device 10 develops the latent image with magenta toner to thereby form a magenta toner image. It is to be noted that the above image data may be input from personal computer or similar host machine to the printer.

A sheet or recording medium is fed from the sheet feeding section 2 to a registration roller pair 13, which is positioned upstream of the belt 12 in the direction of sheet conveyance. The registration roller pair 13 once stops the sheet and then conveys it to the belt 12 in synchronism with the rotation of the drum 5. The belt 12 conveys the sheet to an image transfer position where the belt 12 faces the drum 5. An image transfer roller 14, which contacts the inner surface of the belt 12, transfers the magenta toner image from the drum 5 to the sheet.

The other image forming units 4C, 4Y and 4Bk form respective toner images on their drums 5 in the same manner as the image forming unit 4M. Such toner images are sequentially transferred to the belt 12 one above the other. The printer therefore forms a full-color image on the sheet as rapidly as a monochromatic printer, which forms a monochromatic image. This is an advantage particular to a tandem image forming apparatus.

The sheet with the full-color image is separated from the belt 12 and then conveyed to a fixing device 15. The fixing device 15 fixes the full-color image formed on the sheet. The sheet or print coming out of the fixing device 15 is directly driven out of the printer body 1 or is reversed and then driven out to a print tray 16 face down, which is mounted on the top of the printer body 1. Today, the function of discharging prints face down is essential with a printer for stacking sheets in order of page.

The illustrative embodiment monitors the toner content of the developer stored in the developing device 10 and replenishes fresh toner when the toner content decreases. Specifically, a toner container or toner storing means 20 is located at a position remote from the developing device 10, i.e., in the top right portion of the printer body 1 in the illustrative embodiment. A toner replenishing device replenishes fresh toner from the toner container 20 to the developing device 10.

Figure 2:
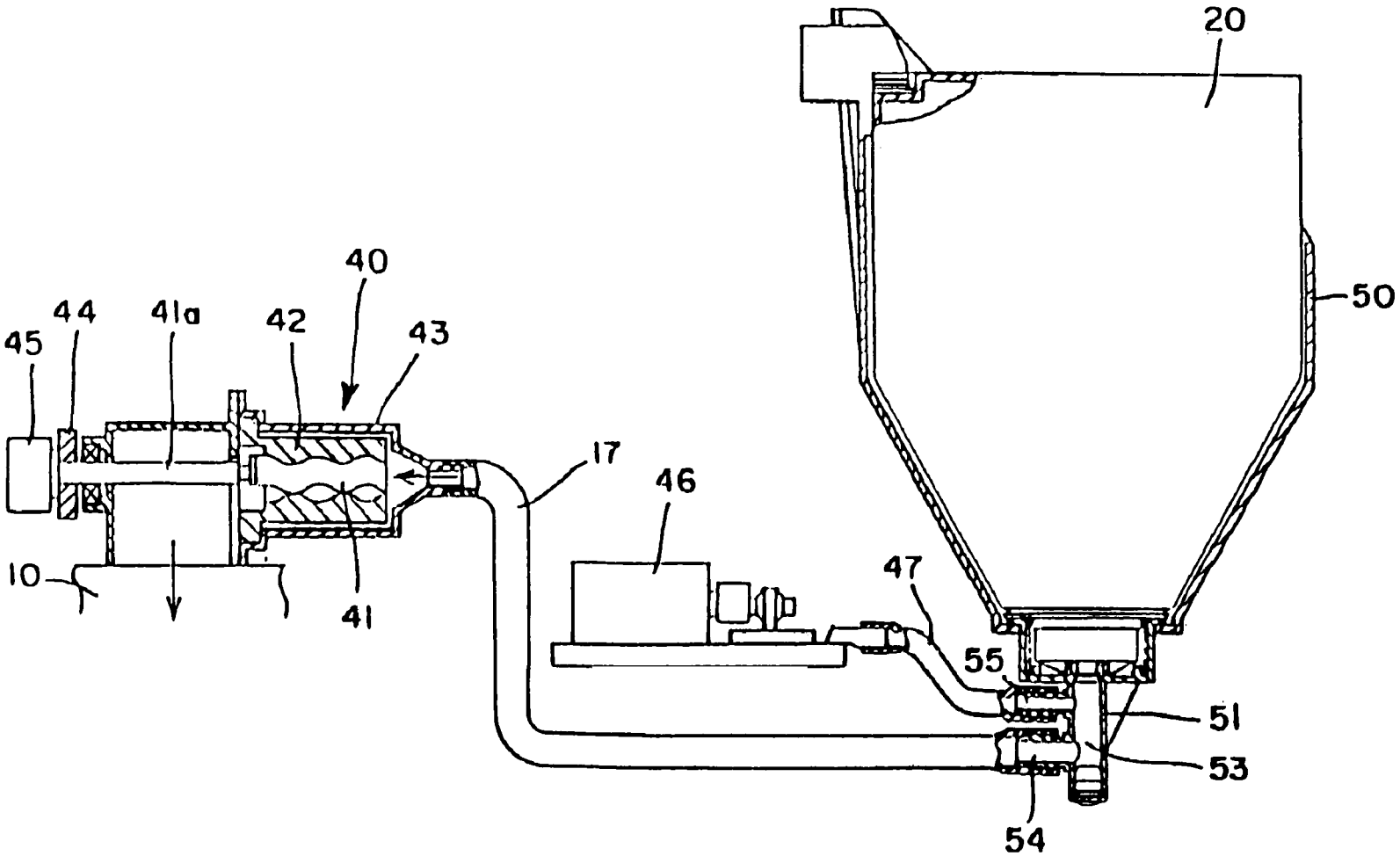
FIG. 2 is a section showing a toner replenishing device included in the image forming apparatus.

FIG. 2 shows a specific configuration of the toner replenishing device. As shown, a suction type powder pump 40 adjoins or is constructed integrally With the developing device 10 and plays the role of sucking means. The powder pump 40, which is a single axis, eccentric screw pump, is generally made up of a screw-like rotor 41, a stator 42, and a holder 43. The rotor 41 is implemented as an eccentric screw formed of metal or similar rigid material. The stator 42 is formed of rubber or similar elastic material. The holder 43 is formed of, e.g., resin and holds the stator 52 in such a manner as to prevent it from rotating. The holder 43 forms a powder conveyance passage. The rotor 41 is connected to a drive shaft 41*a* by pin joint that absorbs the eccentric movement of the rotor 41. A gear 45 is affixed to the drive shaft 45 and selectively driven via a clutch 45.

The holder 43 has a toner inlet at its right end, as viewed in FIG. 2. A nozzle 51, which will be described specifically later, includes a connection port 54. A tube 17 provides fluid communication between the toner inlet of the holder 43 and the connection port 54 of the nozzle 51. The tube 17 should preferably be formed of, polyurethane rubber, nitrile rubber, silicone rubber or similar rubber highly resistant to toner. Such a flexible tube 17 can be easily arranged in any desired direction.

Figure 3:
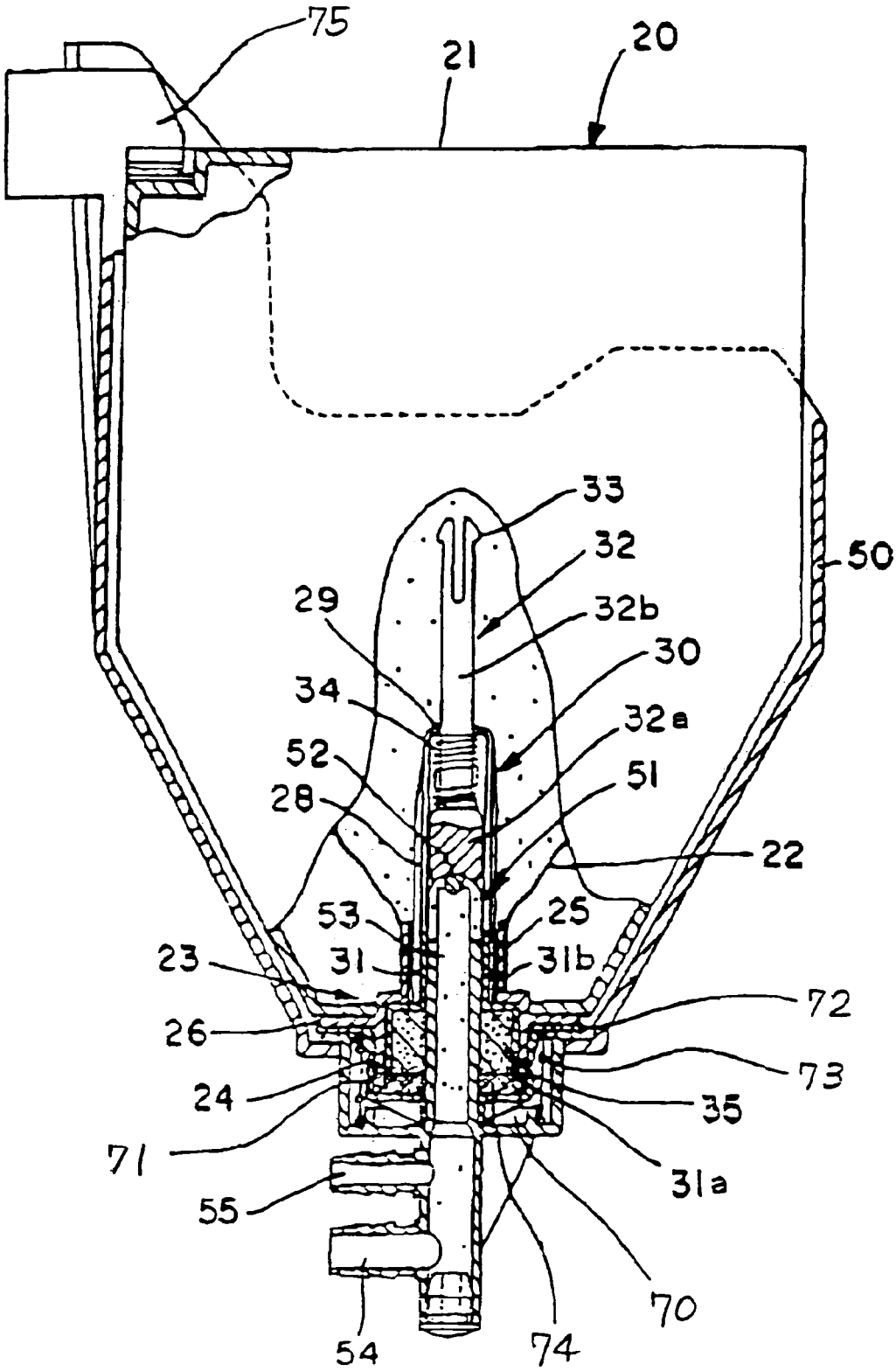
FIG. 3 is an enlarged section showing a container holder or setting portion included in the toner replenishing device.

As shown in FIGS. 2 and 3, the toner container 20 is removably positioned on a container holder or setting portion 50. The nozzle 51 having a circular cross-section extends from the container holder 50 upward. When the toner container 20 is inserted into the container holder 50 downward, the nozzle 51 penetrates into the toner container 20. The upper portion of the nozzle 51 terminates at a conical or spherical tip 52 formed integrally with or affixed to the nozzle 51. The nozzle 51 has a tubular structure having a single wall and forming an air/toner passage 53. An air inlet port 55 is formed in the nozzle 51 above the connection port 54.

A pipe 47 connects an air pump or air feeding means 46 to the air inlet port 55 of the nozzle 51. The air pump 46 implements a flow rate of about 1 litter to 3 litters for a minute. The air pump 46 in operation sends air into the toner container 20 via the pipe 47 and air/toner passage 53. Air sent into the toner container 20 dashes through the toner layer present in the toner container 20, fluidizing the toner by agitating it. As a result, the toner whose fluidity is originally low becomes as fluid as liquid. A check value, not shown, may be positioned in the pipe 47 for preventing the toner from entering the air pump 46.

As shown in FIG. 3, the toner container 20 has a bag-in-box structure made up of a box or protection case 21 and a deformable, hermetic toner bag or container body 33 received in the box 21. The box 21 is formed of paper, corrugated paper, resin or similar rigid material and has a space great enough to accommodate the toner bag 22. The toner bag 22 has its major part implemented by a polyester sheet, polyethylene film or similar flexible sheet in the form of a single layer or a plurality of layers. The flexible sheet is about 80 μm to 200 μm thick and folded in the same manner as in the art of paper folding. The major part of the toner bag 22 is tapered from a suitable intermediate portion thereof toward a toner outlet downward, so that the toner can be easily discharged.

A mouth member 23 is fitted in the toner outlet positioned at the bottom center of the tapered toner bag 22. The mouth member 23 is formed of polyethylene resin, nylon resin or similar resin. The mouth member 23 includes a first or larger diameter portion 24 to which the toner bag 22 is adhered or welded, a second or smaller diameter portion 25 to which shutter means 30, which will be described later, is adhered or otherwise affixed, and a flat third portion 26 removably connecting the toner bag 22 to the box 21. The third portion 26 is positioned between the first portion 24 and the second portion 25.

Figure 6:
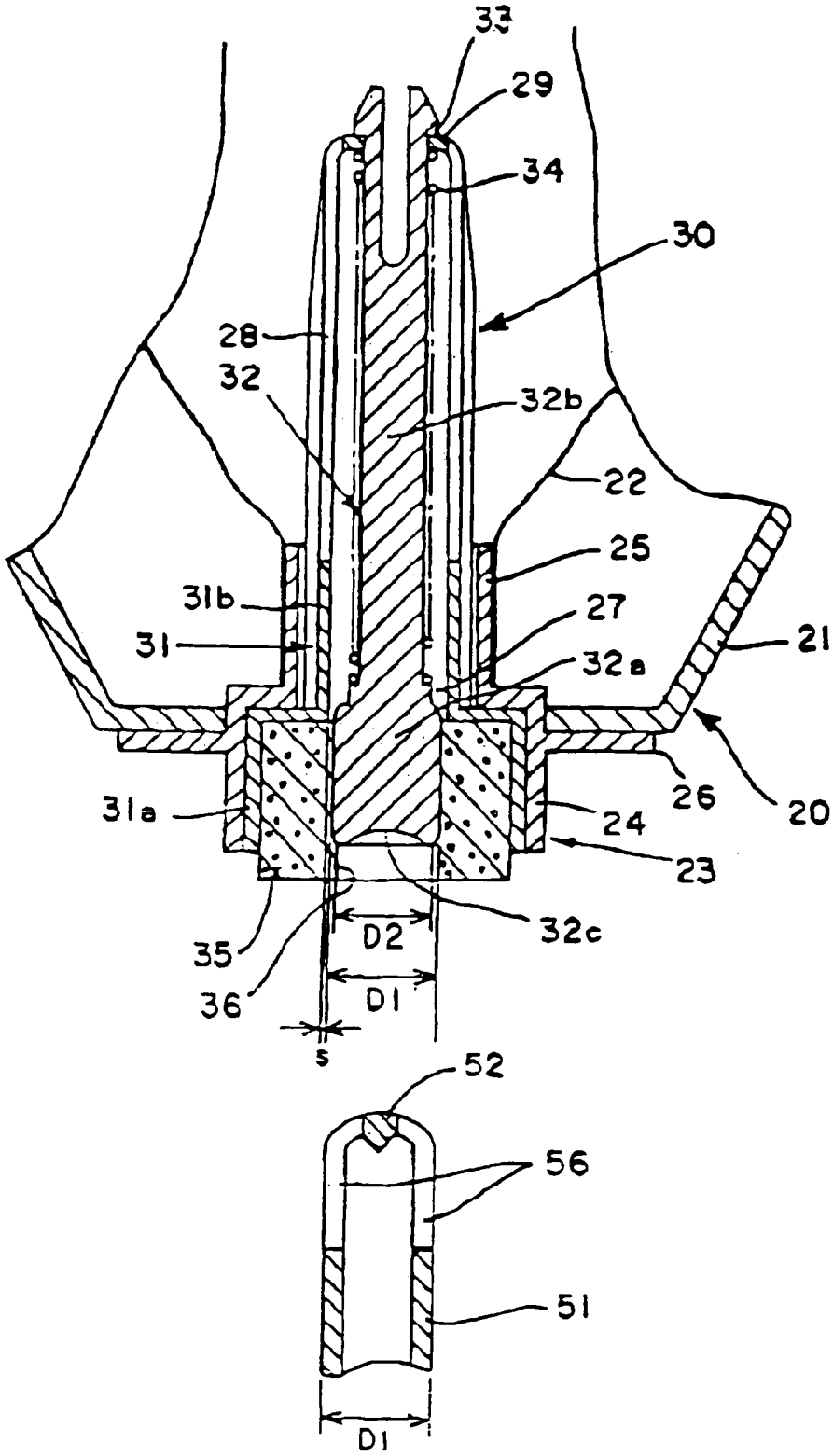
FIG. 6 is an enlarged section showing the shutter means.

A through hole 27 (see FIG. 6) extends throughout the mouth member 23. As shown in FIG. 6, The through hole 27 has a two-step structure that is larger in diameter at the second portion 24 side than at the first portion 25 side.

Figure 4:
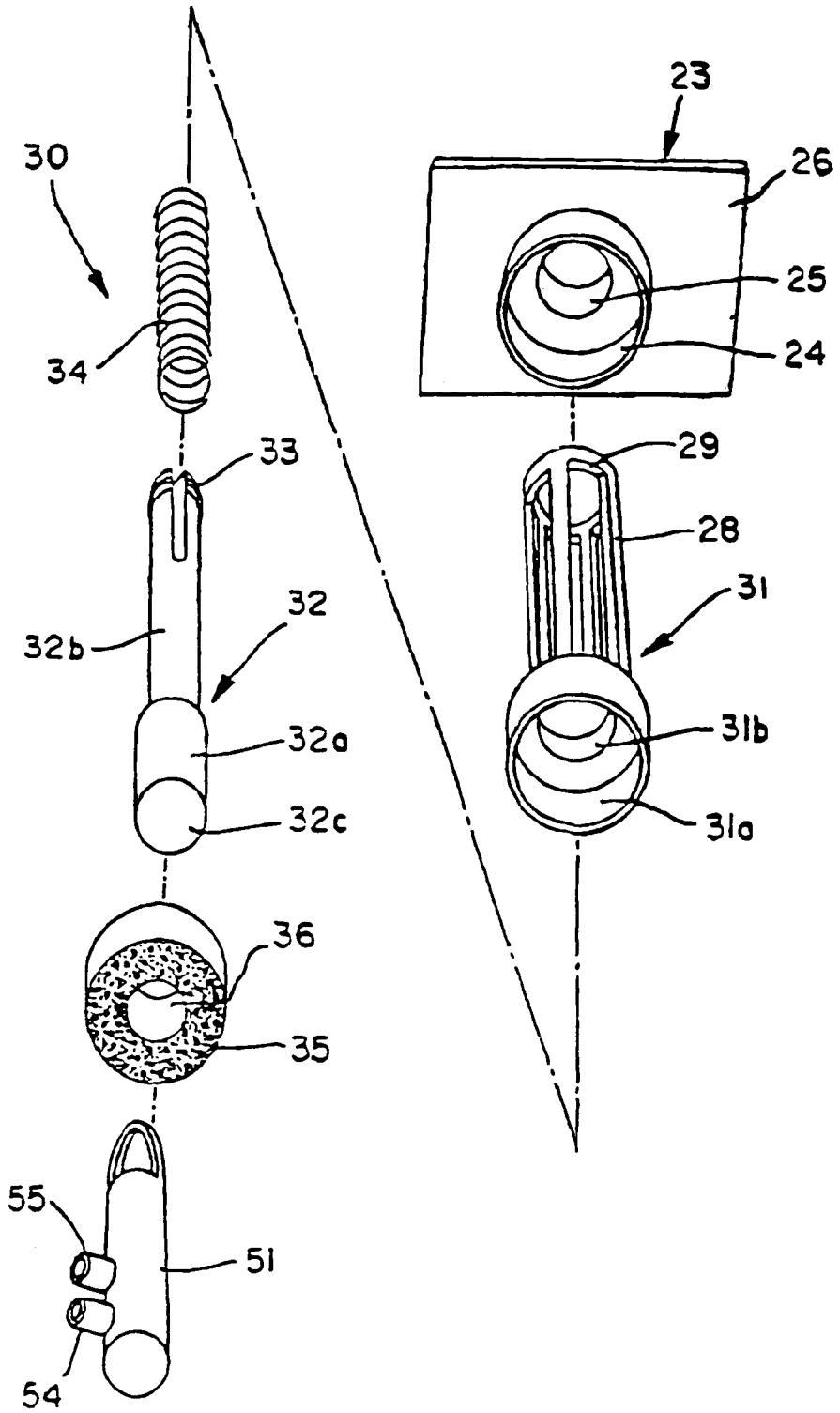
FIG. 4 is an exploded isometric view showing shutter means included in the illustrative embodiment.

As shown in FIGS. 3 and 4, the shutter means 30 includes a support member 31 formed with a two-step through hole like the mouth member 23 and adhered or otherwise affixed to the mouth member 23. A piston member or opening/closing member 32 is movable in the through hole of the support member 31. The piston 32 is made up of a piston 32*a* and a piston rod 32*b* formed integrally with the piston 32*a*. A stop claw 33 is formed at the end of the piston rod 32*b* remote from the piston 32*a*. Beam members 28 extend upward from a smaller diameter portion 31*b*, which is included in the support member 31 and forms part of the two-step through hole. A ring portion 29 connects the beam members 28 to each other. The stop claw 33 and ring portion 29 are engaged with each other, constituting stop means.

Figure 5:
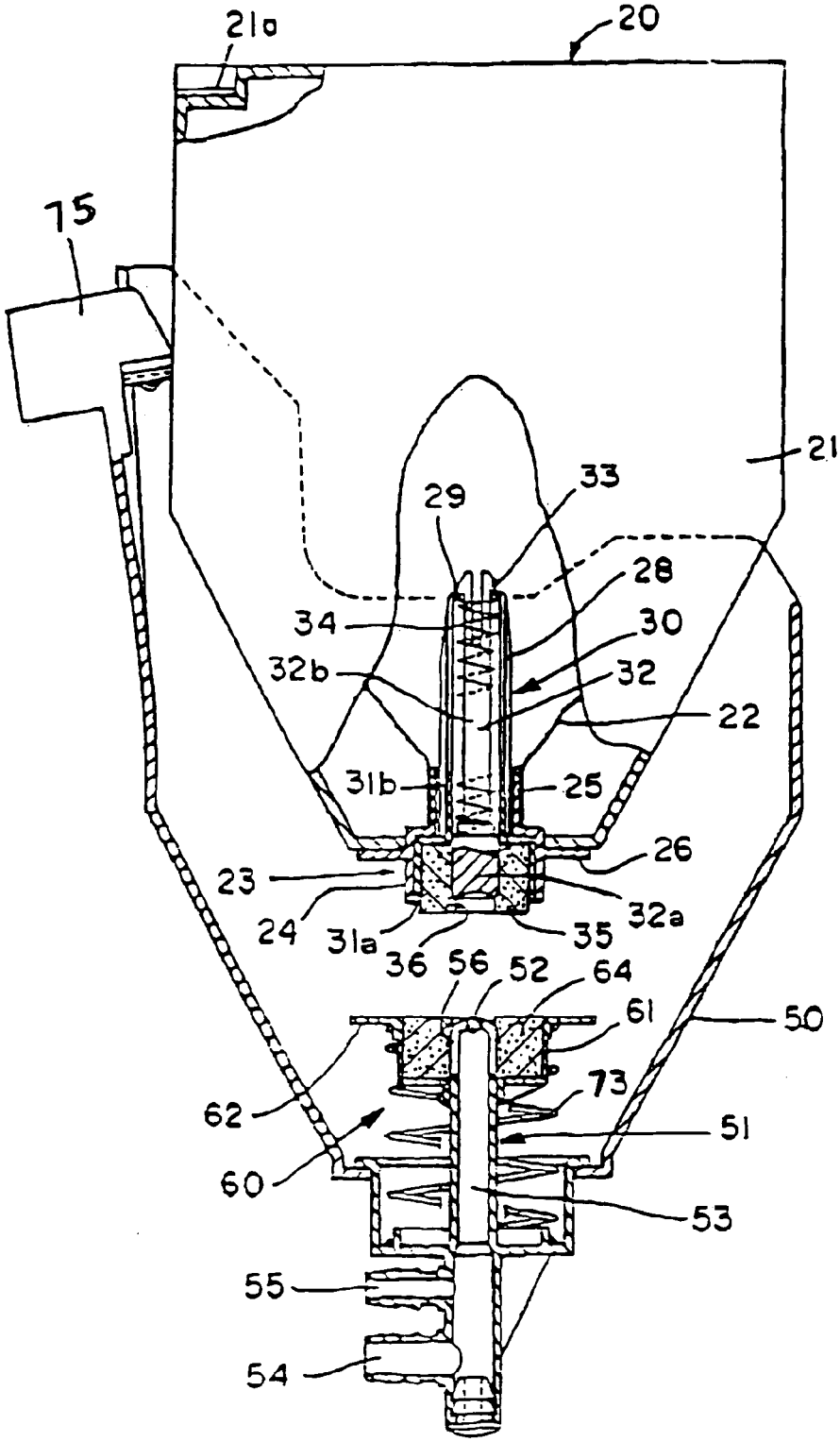
FIG. 5 is a section showing the toner container removed from the container holder.

Further, a compression coil spring or resilient member 34 surrounds, but is spaced from, the piston rod 32. The coil spring 34 is seated on the piston member 32 and ring portion 29 at opposite ends thereof, constantly biasing the piston member 32 downward. More specifically, the coil spring 34 constantly biases the piston member 32 downward against the nozzle 51, as viewed in FIG. 3. However, as shown in FIG. 5, when the nozzle 51 is pulled out of the mouth member 23, the piston member 32 is held in the position where the stop claw 33 is retained by the ring member 29. A seal member 35 is fitted in a larger diameter portion 31*a*, which formed the other part of the two-step hole of the support member 31. The seal member 35 is formed of foam sponge, rubber or similar elastic material and formed with a through hole 36 at its center.

FIG. 3 shows the piston member 32 in an opening position where it opens the toner outlet by being pushed upward by the nozzle 51 against the action of the coil spring 34. FIG. 5 shows the piston member 32 in a closing position where it closes the toner outlet. In the closing position, the circumference of the piston 32*a* is held in slidable contact with the seal member 35.

As shown in FIG. 6, assume that the piston 32*a* and the hole 36 of the seal member 35 have diameters of D1 and D2, respectively. Then, in the illustrative embodiment, the diameter D1 is selected to be greater than the diameter D2. This allows the piston 32*a* to contact the seal member 35 over its entire circumference in the closing position of the piston member 32. The nozzle 51 is provided with the same diameter and shape D1 as the piston 32*a*. Further, assume that the inside diameter of the smaller diameter portion 31*b* of the support member 31 and the circumference of the piston 32*a* are spaced by a gap s. Then, in the illustrative embodiment, the gap s is selected to be 0.2 mm or above in order to prevent the above portion 31*b* from obstructing the movement of the piston member 32.

In the above configuration, the shutter means 30 biased by the coil spring 34 surely closes the toner outlet of the toner container 20 when the toner container 20 is removed from: the nozzle 51 without regard to low temperature or similar environmental condition. In the closing position, although the piston member 32 slidingly contacts the seal member 35, the hole 36 of the seal member 35 prevents the seal member 35 from being partly torn off despite that the seal member 35 is formed of, e.g., sponge. Further, although the piston 32*a* remains in the bottom portion of the toner container 20 in the closing position, it slides deep into the container 20 away from the closing position when the nozzle 51 is fully inserted into the container 20. In this manner, in the illustrative embodiment, the distance between the closing position and the opening position of the piston member 32 is great enough to prevent the piston member 32 from obstructing the discharge of the toner when held in the opening position.

The piston 32*a* of the piston member 32*a* has a bottom 32*c* facing the tip 52 of the nozzle 51. The bottom 32*c* and tip 52 are so configured as to closely contact each other without any gap. For example, the bottom 32*c* and tip 52 both may be implemented at flat faces. In the illustrative embodiment, the tip 52 is implemented as a spherical, convex surface while the bottom 32*c* is implemented as a concave surface complementary to the convex surface, i.e., identical in diameter as the convex surface. This allows the bottom 32*c* and tip 52 to surely align with each other even when the nozzle 51 being inserted into the toner container 20 is slightly shifted from the piston member 32.

Figure 7:
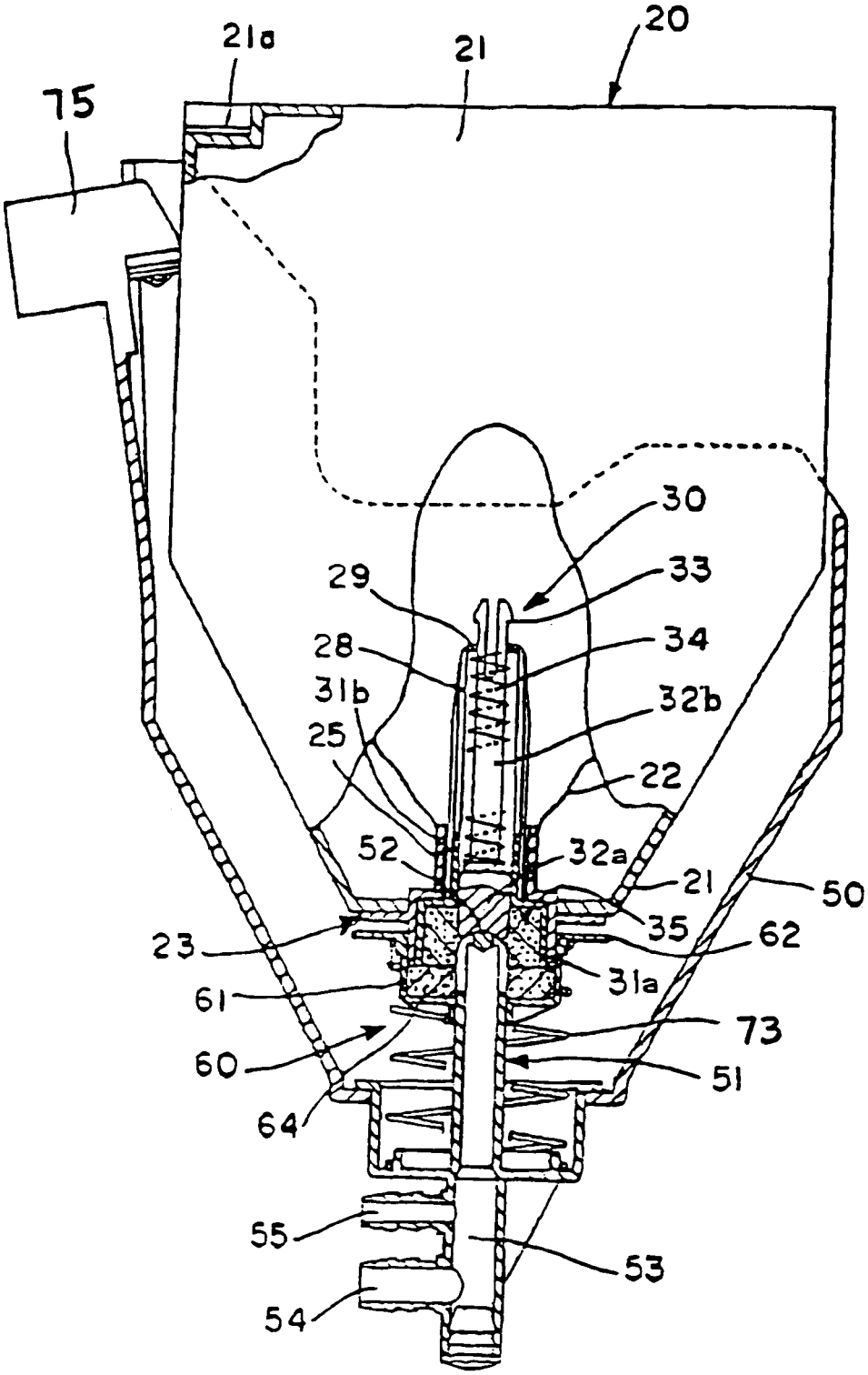
FIG. 7 is a section showing how the toner container is removed from the container holder.

The piston member 32 and nozzle 51 aligning with and closely contacting each other, as stated above, prevent the toner from leaking via the toner outlet when the toner container 20 is pulled away from the nozzle 51. More specifically, as shown in FIG. 7, when the toner container 20 is pulled away from the nozzle 51, the nozzle 51 contacting the seal member 35 together with the piston member 32 moves away from the piston member 32. At this instant, if the piston member 32 and nozzle 51 are not axially aligned, then a gap temporarily appears between the piston member 32 and the seal member 35 and causes the toner to leak. Moreover, the bottom 32*c* of the piston member 32 and the tip 52 of the nozzle 51 closely contacting each other prevent the toner from dropping toward the toner outlet.

As shown in FIG. 6, the mouth member 23 and support member 31 are adhered together to constitute a single member. The smaller diameter portion 24 of the mouth member 23 and the smaller diameter portion 31*b* of the support member 31 both extend upward at the center. The smaller diameter portion 31*b* is positioned inside the smaller diameter portion 24, forming a double-wall structure. The toner bag 22 is adhered, welded or otherwise affixed to the smaller diameter portion 24.

The mouth member 23 and support member 31 may be implemented by a single member. However, the single member would make it difficult to fill the toner container 20 with the toner via the toner outlet because the shutter means 30 would be fitted on the mouth member 23 beforehand. The illustrative embodiment fills the toner container 20 with the toner before adhering the support member 31 to the mouth member 23 and then affixes the support member 31 supporting the shutter means 30. The toner can therefore be smoothly introduced into the toner container 20 without being blocked by the shutter means 30.

Although the toner bag 22 filled with the toner is flexible, the box 21 accommodating the toner bag 22 protects it from shocks and impacts. In addition, the box 21 is easy to handle and store.

Figure 8:
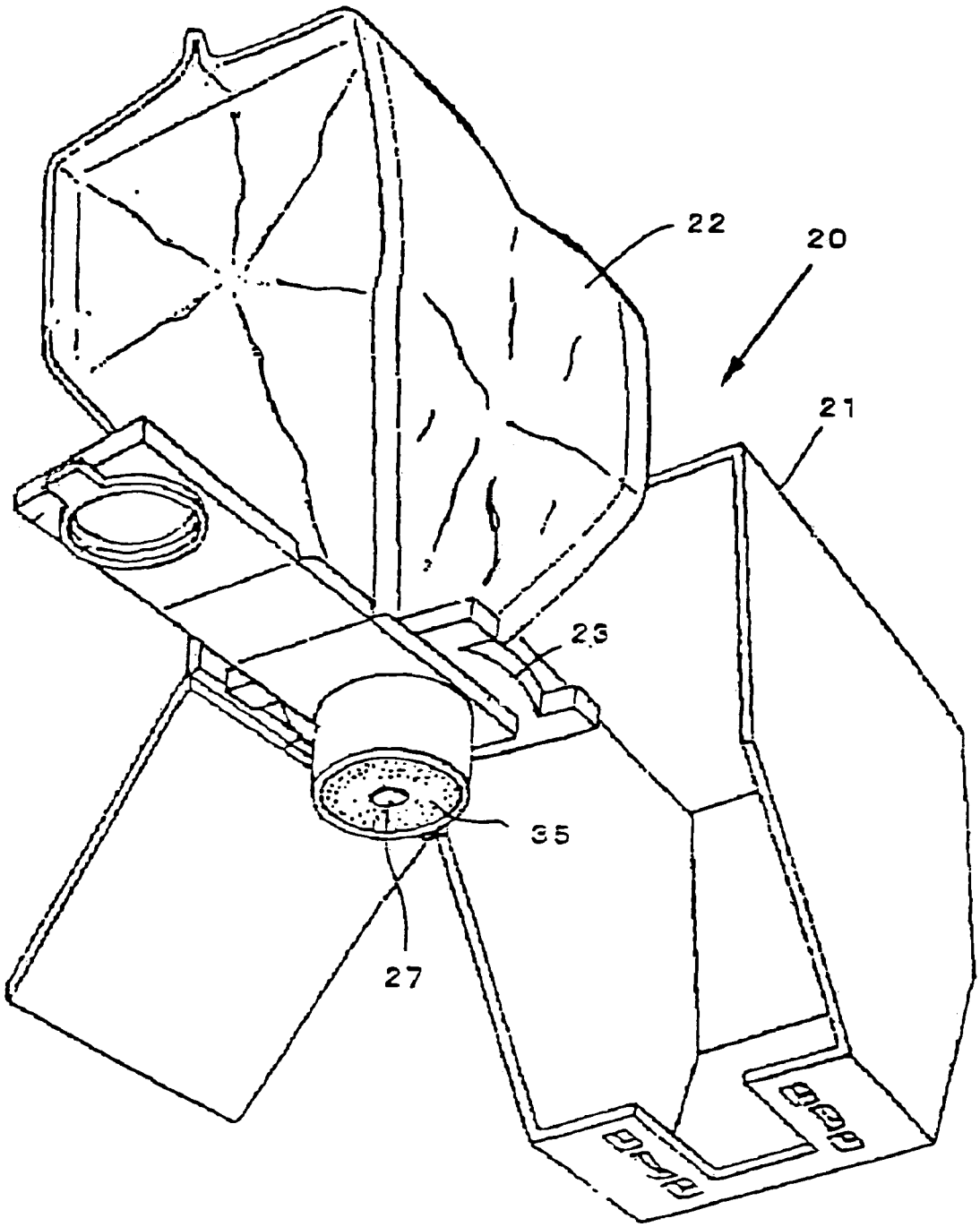
FIG. 8 is an external isometric view of the toner container with the shutter means, as seen from obliquely below.
Figure 9:
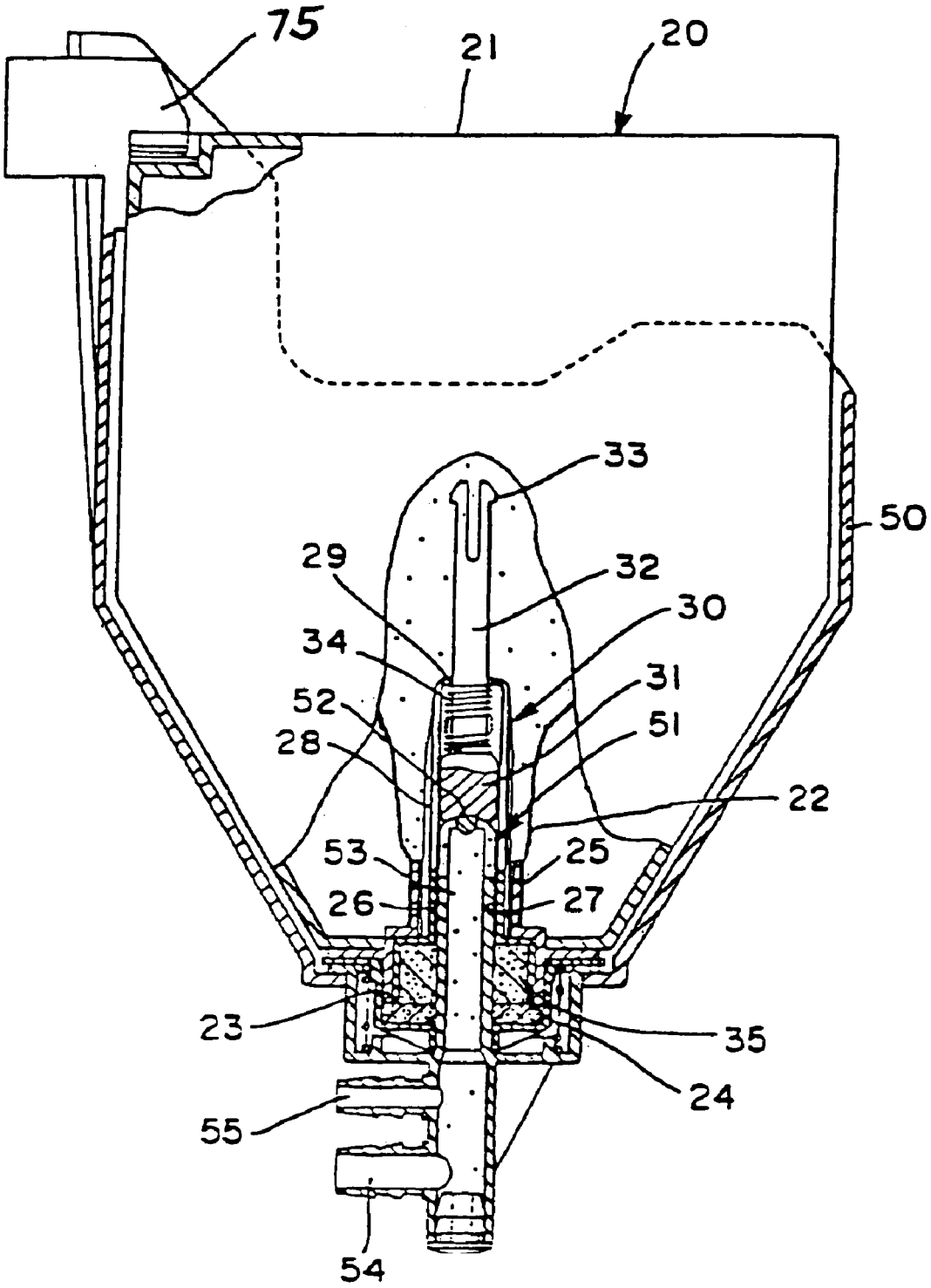
FIG. 9 is a section showing a toner container apt to cause toner to stay therein.

The shutter means 30, however, reduces the area of the toner outlet of the toner bag 22 and is apt to cause the toner to remain in the toner bag 22. This is because the toner bag 22 is tapered toward the hole 27 and because the shutter means 30 itself it positioned at the tapered portion. Further, it is likely that the tapered portion of the toner bag 22 is folded or bent due to the weight of the toner or a shock or an impact. Then, as shown in FIG. 8, the opposite walls of the toner bag 22 approach each other. Consequently, as shown in FIG. 9, the area of the toner outlet guiding the toner to the nozzle 51 decreases, causing the toner to stay without being discharged.

Figure 10:
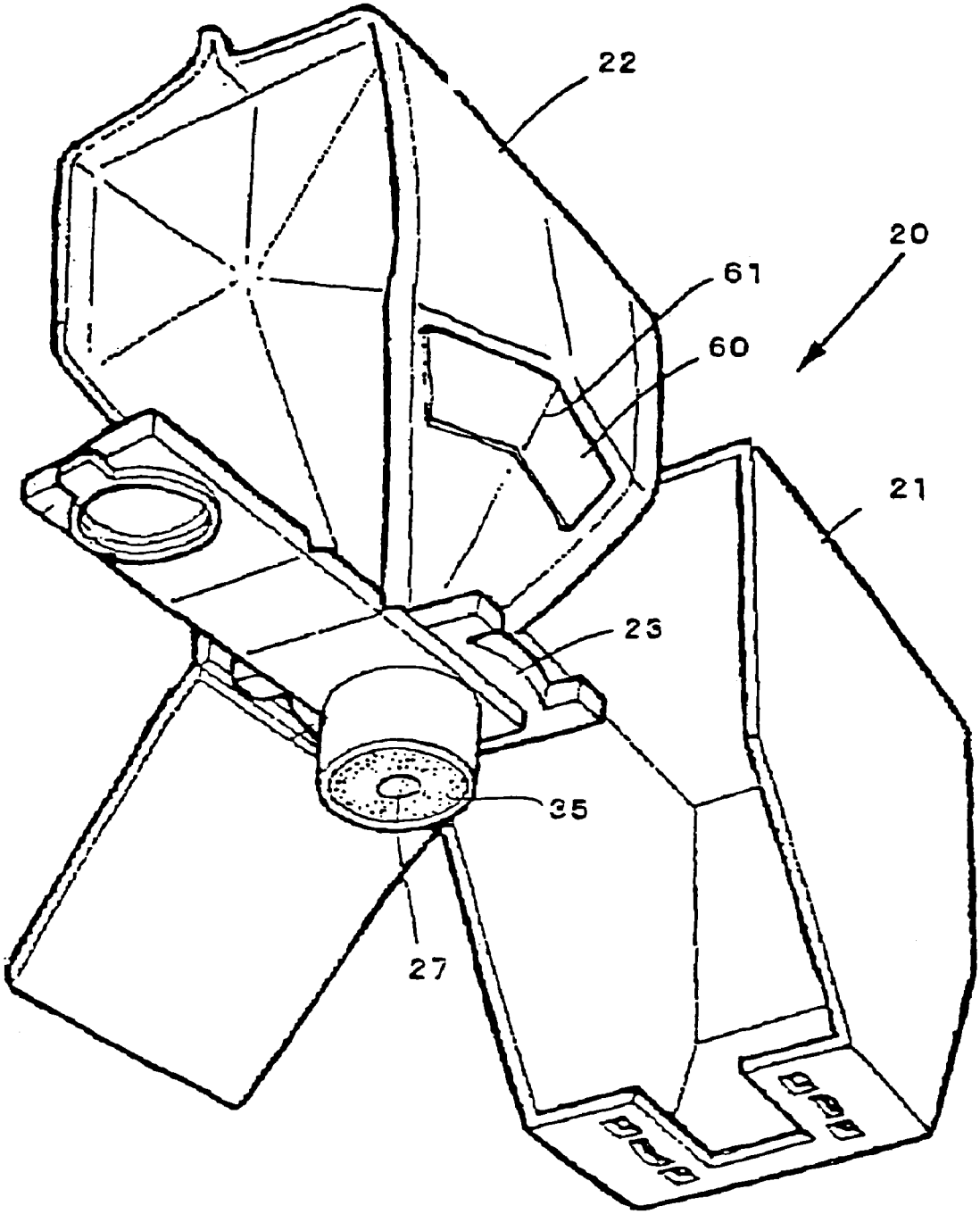
FIG. 10 is an external isometric view of a toner container with a bent member adhered thereto.
Figure 11A:
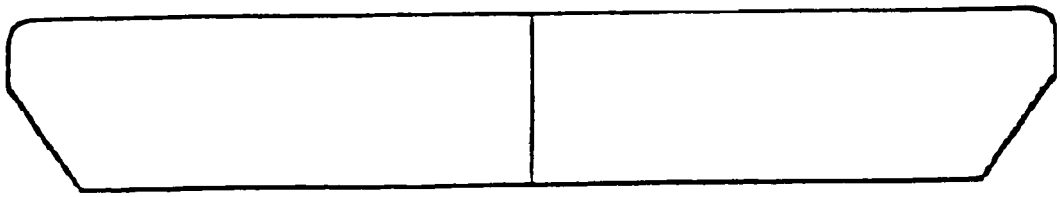
FIGS. 11A and 11B are respectively a front view and a plan view showing the bent member.
Figure 11B:
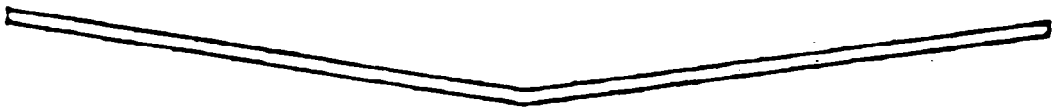

In light of the above, as shown in FIG. 10, the illustrative embodiment further includes a bent member 60 that prevents the toner from staying in the toner bag 22. The bent member 60 is formed of, e.g., Mylar (trade name) or similar elastic plastics. As shown in FIGS. 11A and 11B, the bent member 60 is an elongate thin member more rigid than the toner bag 22 and bent at the center to form a peak 61. Two bent members 60 (only one is visible) are adhered to opposite side walls greater in area than the other side walls such that their peaks 61 protrude away from each other. The bent members 60 should preferably be positioned in the vicinity of or slightly above the ring portion 29 of the shutter means 30. The effect of the bent members 60 would be halved if they were positioned at an extremely high level or on the tapered portion. As shown in FIGS. 11A and 11B, the corners of each bent member 60 are rounded so as not to damage the toner bag 22.

The bent members 60 adhered to the toner bag 22 maintain the toner bag 22 in an outwardly expanded shape. Therefore, as shown in FIG. 3, the portion of the toner bag 22 that guides the toner toward the nozzle 51 in the vicinity of the shutter means 30 has a sufficient open area, preventing the toner from staying there. In addition, the bent members 60 prevent the toner bag 22 from bending in the vicinity of the shutter means 30 and thereby prevent the toner from bridging.

While the bent members 60 may be more rigid than the toner bag 22, as stated above, they should preferably be elastic so as to be easily adhered to the toner bag 22.

Figure 12:
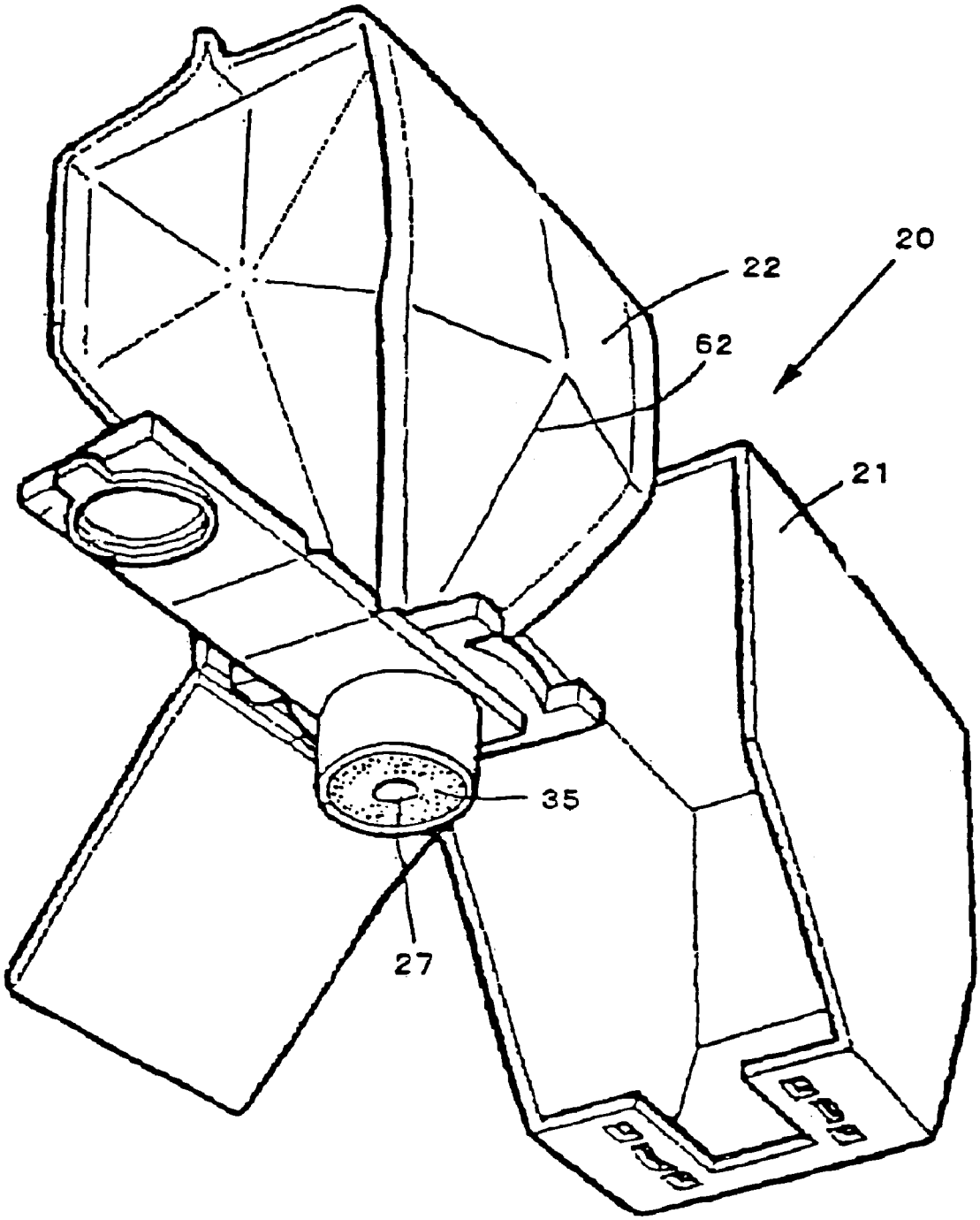
FIG. 12 is an external isometric view showing a modification of the illustrative embodiment.

FIG. 12 shows a modification of the toner container 20. As shown, the toner bag 22 itself is formed with folds 62 in place of the bent members 60. The folds 62 are positioned at substantially the same level as the peaks 61 of the bent members 60 slightly above the shutter means 30. The toner container 20 with the folds 62 can prevent the toner from staying in the portion that guides the toner to the nozzle 51 without resorting to the bent members 60.

Figure 13:
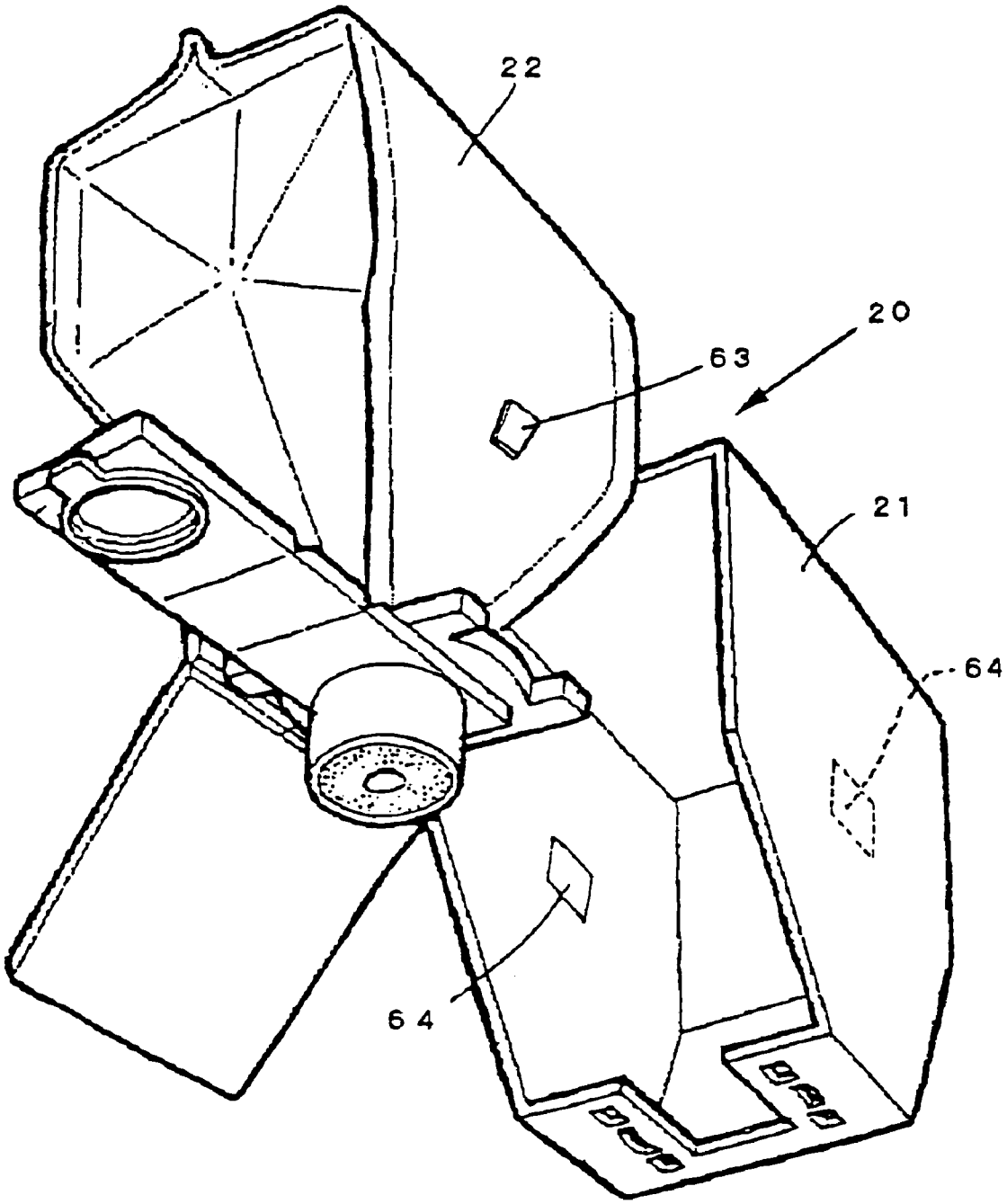
FIG. 13 is an external isometric view showing another modification of the illustrative embodiment.

FIG. 13 shows another modification of the toner container 20. As shown, two magnets 63 (only one is visible) are adhered to opposite side walls of the toner bag 22 slightly above the shutter means 30. Metal pieces or magnetic pieces 64 are adhered to opposite side walls of the box 21 corresponding to the side walls of the toner bag 22. When the toner bag 22 is inserted into the box 21, the magnets 63 magnetically adhere to the metal pieces 64, broadening the portion of the toner bag 22 that guides the toner. This is also successful to prevent the toner from staying in the above portion of the toner bag 22. The magnets 63 and magnetic pieces 64 may be respectively fitted on the box 21 and toner bag 22, if desired. Also, the magnetic pieces 64 may also be implemented as magnets that attract the magnets 63.

In the toner replenishing device shown in FIG. 2, the rotor 41 in rotation generates high suction pressure in the powder pump 40, so that the toner is sucked out of the toner container 20. More specifically, the toner drops to the vicinity of the nozzle 51 due to gravity and is conveyed to the outside of the toner container by the suction of the powder pump 40. However, the toner for the electrophotographic process has low fluidity and is therefore apt to bridge around the nozzle inside the toner container 20 after being sucked by the powder pump 40. The illustrative embodiment sends compressed air from the air pump 30 to the inside of the toner container 20 for thereby agitating and fluidizing the toner. Compressed air sent into the toner container 20 loosens even the bridged toner and thereby insures stable toner replenishment while reducing the toner to remain in the toner container 20.

Figure 14:
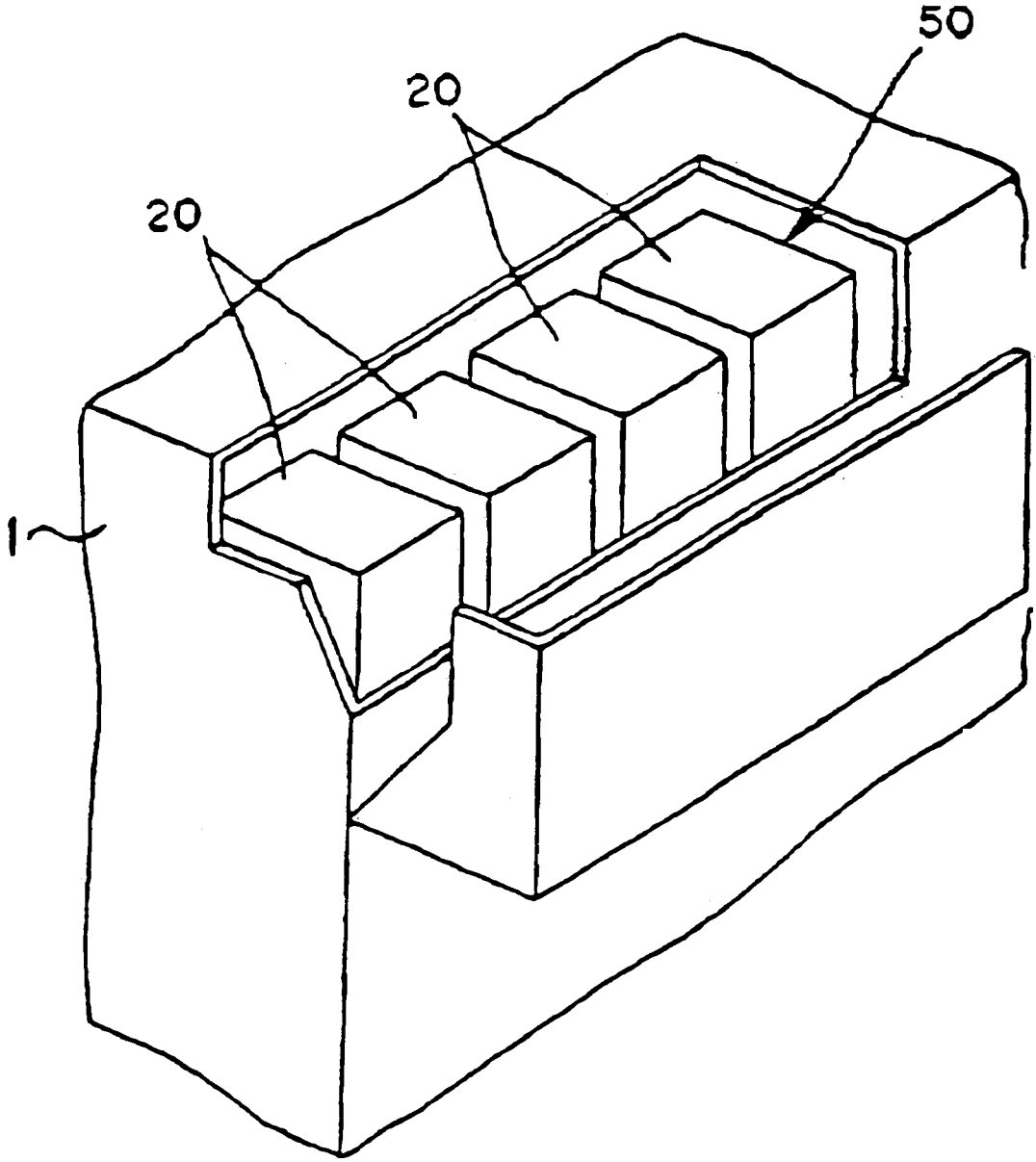
FIG. 14 is an external isometric view showing a specific arrangement of four toner containers in the container holder.

The full-color image forming apparatus described above uses four toner containers 20 storing magenta toner, cyan toner, yellow toner and black toner, respectively. As shown in FIG. 14, such four toner containers 20 may advantageously be arranged side by side in the container holder 50. Of course, the toner containers 20 may adjoin each other in a square configuration. In any case, the toner containers 20 should preferably adjoin each other with some rule with their tops being flush with each other. This arrangement, however, makes it difficult for the operator to grip the individual toner container 20 when, e.g., it runs out of toner. While the space between nearby toner containers 20 may be increased to allow the operator to grip one of them without touching the other toner containers 20, such a space is not practical because of a limited space available in the container holder 50.

In light of the above, as shown in FIG. 3, the illustrative embodiment additionally includes thrusting means 70 for pushing up the toner container 20 set in the container holder 50. The trusting means 70 includes a movable support frame 71 having a generally U-shaped section and formed with a flange 72 at its top edge. A spring or biasing member 73 constantly biases the support frame 71 upward. A seal 74 is received in the support frame 71 and formed of sponge or similar elastic material. The seal 74 is adhered or otherwise affixed to the support frame 71 and formed with a slit at its center. The slit allows the nozzle 51 to penetrate into the seal 74.

The spring 73 is a coil spring loaded between the wall of the container holder 50 and the support frame 71 and forces the flange 72 of the support frame 71 upward. When the toner container 20 is absent in the container holder 50, the spring 73 maintains the support-frame 71 at the uppermost position shown in FIG. 3. The length and biasing force of the spring 73 are so selected as to prevent the support frame 71 held at the uppermost position from slipping out of the nozzle 51.

A stop 75 retains the toner container 20 correctly set in the container holder 50. As shown in FIGS. 3 and 5, the stop 75 is formed integrally with the container holder 50. The container holder 50 is formed of plastics or sheet metal, so that the stop 75 has adequate resiliency. The stop 75 retains the top of the box 21 of the toner container 20, as illustrated. The box 21 is formed with a recess 21*a* that mates with the stop 75.

When the toner container 20 is correctly set in the container holder 50, it compresses the spring 73 while the stop 75 resiliently mates with the recess 21*a* of the box 21. The toner container 20 is therefore locked in the container holder 50. To pick up the toner container 20, the operator releases the stop 75 from the recess 21*a*. Then, the spring 73 thrusts the toner container 20 upward, as shown in FIG. 5. Therefore, even when four toner containers 20 are arranged side by side with a minimum of space there between, as shown in FIG. 14, the toner container 20 to be picked up is raised above the other toner containers 20 and can be easily picked up.

As for the biasing force of the spring 73, the toner container 20 is, in many cases, picked out of the apparatus for the purpose of replacement. It follows that the biasing force of the spring 73 should only be strong enough to push up the empty toner container 20. Further, the coil spring 34 of the shutter means 30 constantly biases the toner container 20 upward like the spring 73. Assume that frictional resistance F acts on the seal valve 24 when the toner container 20 is pulled out of the nozzle 40, and that the empty toner container 20 has a weight of M. Then, the sum of the force of the spring 73 and that of the coil spring 34 should only be greater than the sum of F and M. Further, the biasing force of the spring 73 should only be smaller than the sum of F and the weight N of the full toner container 20.

While the illustrative embodiment and modifications thereof have concentrated on toner, the present invention is applicable to any kind of powder.

In summary, it will be seen that the present invention provides a toner container and an image forming apparatus using the same that have various unprecedented advantages, as enumerated below.

(1) Shutter means surely closes the toner outlet of the toner container without regard to low temperature or similar environmental condition, thereby preventing toner from leaking. The shutter means is simple, easy to assemble and reliable in operation.

(2) An opening/closing member included in a shutter member does not adjoin the end of the container body in an opening position. The opening/closing member therefore does not interfere with the discharge of the toner, so that the toner can be smoothly replenished. The opening/closing member is usually closed to surely prevent the toner from leaking.

(3) A support member has a through hole made up of a larger diameter portion and a smaller diameter portion. A seal member is adhered to the wall of the larger diameter portion and can therefore be easily fitted on the support member. The seal member is elastic and formed with a through hole through which the opening/closing member can pass. The seal member is therefore preventing from tearing off when a nozzle is inserted, insuring stable toner replenishment.

(4) A gap of 0.2 mm or above exists between the outside diameter of the opening/closing member and the smaller diameter portion of the through hole. The gap insures smooth movement of the opening/closing member and smooth insertion of the nozzle.

(5) A compression spring or resilient member is wound round a piston rod between the piston portion and the ring portion of the opening/closing member. The spring is therefore easy to mount and exerts a biasing force in a preselected direction, promoting the stable closing movement of the shutter means. Further, the piston and the nozzle have the same size as seen in a section, preventing the toner from leaking when the nozzle is inserted or pulled out.

(7) The nozzle has a convex tip and allows the piston to be easily aligned with the nozzle.

(8) The resilient member of the shutter means helps thrusting means push up the toner container when the toner container is to be removed. In addition, the thrusting means surely pushes up the toner container.

(9) Bent members can be easily fitted on a toner bag forming part of the toner container. The bent members surely prevent the toner from staying in the toner bag without damaging the toner bag. This is also true when the toner bag itself is processed instead of using the bent members.

(10) The toner container is easy to set on the image forming apparatus and causes a minimum of toner to leak.

Various modifications will become possible for those skilled in the art after receiving the teachings of the present disclosure without departing from the scope thereof.

What is claimed is:

1. A toner container for use with an image forming apparatus, comprising:

a container body configured to store toner and including, a first end having a first mouth and configured to interface with a setting portion of the image forming apparatus, and a second end opposite to the first end; and a recess positioned at the second end and configured to interface with a retaining member of the image forming apparatus, wherein the container body includes an outer housing and an inner bag.

2. The toner container of claim 1, wherein the recess is integrally formed with the outer housing.

3. The toner container of claim 1, wherein the outer housing is made of a rigid material and the inner bag is made of a deformable material.

4. The toner container of claim 1, wherein, the second end includes a surface having at least two edges, and the recess is located at one of the at least two edges.

5. The toner container of claim 1, further comprising:

a mouthpiece member positioned at the first mouth, the mouthpiece member including a second mouth configured to allow toner stored in the container body to be discharged from the container body; and a shutter configured to control passage of toner through the second mouth.

6. The toner container of claim 5, wherein, the shutter allows passage of toner through the second mouth when the toner container is mounted on the setting portion, and the shutter prevents passage of toner through the second mouth when the toner container is not mounted on the setting portion.

7. A toner container for use with an image forming apparatus, comprising:

a container body configured to store toner and including, a first end having a first mouth and configured to interface with a setting portion of the image forming apparatus, and a second end opposite to the first end; and a recess positioned at the second end and configured to interface with a retaining member of the image forming apparatus, wherein the recess is located at a surface edge of the second end.

8. A toner container for use with an image forming apparatus, comprising:

a container body configured to store toner and including, a first end having a first mouth and configured to interface with a setting portion of the image forming apparatus, and a second end opposite to the first end;

a recess positioned at the second end and configured to interface with a retaining member of the image forming apparatus;

a mouthpiece member positioned at the first mouth, the mouthpiece member including a second mouth configured to allow toner stored in the container body to be discharged from the container body; and a shutter configured to control passage of toner through the second mouth, wherein the shutter includes a piston and a biasing member.

9. A toner container for use with an image forming apparatus, comprising:

a container body configured to store toner and including, a first end having a first mouth and configured to interface with a setting portion of the image forming apparatus, and a second end opposite to the first end; and means for interfacing with a retaining member of the image forming apparatus, wherein the means for interfacing is arranged at the second end, wherein the container body includes an outer housing and an inner bag.

10. The toner container of claim 9, wherein the means for interfacing is integrally formed with the outer housing.

11. The toner container of claim 9, wherein the outer housing is made of a rigid material and the inner bag is made of a deformable material.

12. The toner container of claim 9, wherein the means for interfacing is located at a surface edge of the second end.

13. The toner container of claim 9, wherein, the second end includes a surface having at least two edges, and the means for interfacing is located at one of the at least two edges.

14. The toner container of claim 9, further comprising:

a mouthpiece member positioned at the first mouth, the mouthpiece member including a second mouth configured to allow toner stored in the container body to be discharged from the container body; and means for controlling passage of toner through the second mouth.

15. The toner container of claim 14, wherein, the means for controlling allows passage of toner through the second mouth when the toner container is mounted on the setting portion, and the means for controlling prevents passage of toner through the second mouth when the toner container is not mounted on the setting portion.

16. A method of mounting a toner container to an image forming apparatus, the toner container including, a container body storing toner, a recess arranged on an exterior surface of the container body, and a shutter arranged at a mouth of the container body and configured to selectively allow and prevent discharge of the toner from the container body, and the image forming apparatus including, a container holder including a resilient portion and configured to receive and support the container body, a retaining member arranged at the resilient portion and configured to engage with the recess, and a nozzle configured to protrude through the shutter and enter the container body, the method comprising:

aligning the container body to the container holder such that shutter faces the nozzle and the recess is aligned with the retaining member;

inserting the container body into the container holder to a first position such that the container body displaces the retaining member and the resilient portion from a neutral position;

inserting the container body into the container holder to a second position such that the nozzle enters the shutter; and inserting the container body into the container holder to a third position such that the nozzle enters the container body, the resilient portion returns to the neutral position, and the retaining member engages with the recess.

17. The method of claim 16, wherein, the shutter includes a piston and an elastic member, the elastic member forcing the piston away from an interior of the container body, and the nozzle displaces the piston towards the interior of the container body when the container body is inserted into the container holder to the third position.

18. The method of claim 16, further comprising:

biasing the recess towards the retaining member when the container body is inserted to the third position.

19. The method of claim 18, wherein the biasing includes forcing the container body away from the container holder with a spring.

20. A toner replenishing device for use in an image forming apparatus, comprising:

a toner container including, a container body configured to store toner, a recess arranged on the container body, and a shutter arranged at a mouth of the container body and configured to selectively allow and prevent discharge of the toner from the container body; and a setting portion including, a container holder configured to support the toner container, a retaining member configured to engage with the recess, a resilient portion configured to support the retaining member and to provide movement of the retaining member from a neutral state, and a nozzle configured to protrude through the shutter and enter the container body.

21. The toner replenishing device of claim 20, wherein the setting portion further includes a biasing member configured to force the recess towards the retaining member when the recess is engaged with the retaining member.

22. The toner replenishing device of claim 20, further comprising:

a toner conveyance path extending from the toner container;

a toner delivery device configured to withdraw toner from the toner container and to transport the toner along the toner conveyance path; and an air supplying device configured to supply the toner container with air.

23. A toner container, comprising:

a container body;

an opening through which toner from the container body is to be discharged;

a support internal to the container body and proximate to the opening;

a movable stopper arranged to seal and unseal the toner container; and a coil spring disposed between the support and movable stopper which urges the movable stopper to seal the toner container.

24. A toner container according to claim 23, wherein:

a first end of the support is proximate to the opening, and a second end of the support which is opposite the first end resists the coil spring such that the coil spring urges the movable stopper to seal the toner container.

25. A toner container according to claim 23, wherein:

the movable stopper is a piston.

26. A toner container according to claim 25, wherein:

the piston comprises a shaft.

27. A toner container according to claim 26, further comprising:

toner.

28. A toner container according to claim 23, wherein:

the movable stopper has at least a portion which is cylindrical in shape and which is structured to seal the toner container.

29. A toner container according to claim 23, wherein:

the support includes spaced apart members.

30. A toner container according to claim 29, wherein the spaced apart members extend substantially along an axial direction within the container.

31. A toner container according to claim 23, wherein:

the support has a structure which was formed separately from the container body.

32. A toner container according to claim 23, wherein:

a portion of the movable stopper facing outwardly towards an exterior of the toner container has a shape with a recessed center configured to accommodate a nozzle.

33. A toner container according to claim 23, wherein:

the support comprises a circular hole at a position of the support which is opposite to an end of the support which is proximate to the opening.

34. A toner container according to claim 33, wherein:

the first end of the coil spring is adjacent to the circular hole of the support; and a diameter of the coil spring is larger than a diameter of the circular hole of the support.

35. A toner container according to claim 34, wherein:

the circular hole of the support member is parallel to the opening of the toner container.

36. A toner container according to claim 34, further comprising:

toner.

37. A toner container according to claim 23, further comprising:

a seal attached to the toner container, the seal having a hole thererthrough which is aligned with the opening.

38. A toner container according to claim 37, wherein:

the seal has at least one surface disposed to be exterior to the container body.

39. A toner container according to claim 38, wherein:

the seal comprises an elastic material.

40. A toner container according to claim 39, wherein:

the seal comprises a foam sponge.

41. A toner container according to claim 23, wherein:

the container body comprises resin.

42. A toner container according to claim 41, further comprising:

a bag disposed within the container body for holding therein toner.

43. A toner container according to claim 23, further comprising:

a mouth member secured to the container body.

44. A toner container according to claim 43, wherein:

the mouth member has a structure which was formed separately from a structure of the container body.

45. A toner container according to claim 23, further comprising:

toner.

46. A toner container according to claim 23, further comprising:

a recess positioned at an end of the container body which is opposite to the opening, the recesses configured to interface with a retaining member of an image forming apparatus, wherein the recess is located at a surface edge of the second end.

47. A toner container according to claim 46, wherein, the end of the container body which is opposite to the opening includes a surface having at least two edges, and the recess is located at one of the at least two edges.

* * * * *